US010363177B2

(12) United States Patent
Hobbs et al.

(10) Patent No.: US 10,363,177 B2
(45) Date of Patent: Jul. 30, 2019

(54) FOLDING STRETCHER

(71) Applicant: FIBRELIGHT DEVELOPMENTS LIMITED, Reading, Berkshire (GB)

(72) Inventors: Anthony James Patrick Hobbs, Berkshire (GB); David Allan Taylor, Hertfordshire (GB)

(73) Assignee: FIBRELIGHT DEVELOPMENTS LIMITED, Devon (GB)

( * ) Notice: Subject to any disclaimer, the term of this patent is extended or adjusted under 35 U.S.C. 154(b) by 378 days.

(21) Appl. No.: 14/905,284

(22) PCT Filed: Jul. 3, 2014

(86) PCT No.: PCT/GB2014/052021
§ 371 (c)(1),
(2) Date: Jan. 14, 2016

(87) PCT Pub. No.: WO2015/008027
PCT Pub. Date: Jan. 22, 2015

(65) Prior Publication Data

US 2016/0158076 A1 Jun. 9, 2016

(30) Foreign Application Priority Data

Jul. 15, 2013 (GB) ..... 1312632.1

(51) Int. Cl.
*A61G 1/013* (2006.01)
*A61G 7/10* (2006.01)
(Continued)

(52) U.S. Cl.
CPC ..... *A61G 1/013* (2013.01); *A61G 1/044* (2013.01); *A61G 1/048* (2013.01); *A61G 7/1051* (2013.01); *A61G 1/01* (2013.01)

(58) Field of Classification Search
CPC ..... A61G 1/013; A61G 1/04; A61G 1/048; A61G 1/044; A61G 1/01; A61G 1/06; A61G 7/103; A61G 7/1038; A61G 7/1051
See application file for complete search history.

(56) References Cited

U.S. PATENT DOCUMENTS 722,456 A * 3/1903 Reeves ..... A61G 1/013 5/187
722,458 A * 3/1903 Reeves ..... F16H 3/663 475/277

(Continued)

FOREIGN PATENT DOCUMENTS

CA 2641721 A1 4/2009
CN 202605140 U 12/2012

(Continued)

OTHER PUBLICATIONS

International Search Report dated Sep. 29, 2014 in PCT/GB2014/052021, 3 pages.

(Continued)

*Primary Examiner* — Robert G Santos
*Assistant Examiner* — David R Hare
(74) *Attorney, Agent, or Firm* — Foley & Lardner LLP

(57) ABSTRACT

A rescue device includes at least two parallel columns defining a core section. The columns are located in a substantially flat plane with each column lying adjacent at least one other column. Each column includes rods, a connection device, and at least one sleeve. Each rod is located within a sleeve and the rods are connectable in series by the connection devices to form a column. The rescue device further includes at least one linking element. Each sleeve is connected to at least one linking element.

17 Claims, 2 Drawing Sheets

(51) Int. Cl.

| | |
|---|---|
| ***A61G 1/044*** | (2006.01) |
| ***A61G 1/048*** | (2006.01) |
| *A61G 1/01* | (2006.01) |

(56) References Cited

U.S. PATENT DOCUMENTS 2,272,681 A * 2/1942 Smith, Jr. ..... A44B 19/301 24/387
2,489,828 A * 11/1949 Springer ..... A61G 1/01 5/625
2,728,089 A * 12/1955 Hynes ..... A47C 19/027 5/659
3,225,985 A * 12/1965 Romney ..... A45F 3/10 224/153
3,336,060 A * 8/1967 Bradford ..... A61G 1/003 403/108
3,912,138 A * 10/1975 Pava ..... A45F 4/04 224/154
4,124,908 A * 11/1978 Burns ..... A61F 5/3776 2/69.5
4,211,218 A * 7/1980 Kendrick ..... A61F 5/05883 128/870
4,601,075 A * 7/1986 Smith ..... A61G 1/044 128/870
4,679,260 A * 7/1987 Frettem ..... A61G 1/01 5/627
4,922,562 A 5/1990 Allred
5,577,281 A * 11/1996 Mital ..... A61G 1/01 5/625
5,704,081 A * 1/1998 Bollinger ..... A61G 7/1026 5/81.1 T
5,720,303 A * 2/1998 Richardson ..... A61G 1/01 128/870
6,061,853 A * 5/2000 Laaksonen ..... A61G 1/007 5/625
6,216,296 B1 * 4/2001 Carrasco ..... A61G 1/013 2/108
6,276,698 B1 * 8/2001 Calandra ..... B62B 15/00 280/18
6,668,397 B2 * 12/2003 Olenick ..... A47C 17/64 296/190.02
6,948,203 B2 * 9/2005 Tsai ..... A45F 4/02 5/626
7,708,019 B2 * 5/2010 Kendrick ..... A61F 5/05883 128/846
9,668,908 B1 * 6/2017 Al-Azmi ..... A61F 5/3776
2010/0203780 A1 * 8/2010 Hobbs ..... A61G 1/013 441/80
2013/0086748 A1 4/2013 Walter

FOREIGN PATENT DOCUMENTS

| | | | |
|---|---|---|---|
| GB | 1 910 14198 | A | 9/1911 |
| GB | 759977 | A | 10/1956 |
| GB | 2 451 127 | A | 1/2009 |
| GB | 2 495 351 | A | 4/2013 |
| WO | WO-2009/010777 | A1 | 1/2009 |
| WO | WO-2013/086540 | A2 | 6/2013 |

OTHER PUBLICATIONS

Search Report dated Jun. 30, 2014, in Great Britain Application No. 1312632.1, 2 pages.

* cited by examiner

FOLDING STRETCHER

CROSS REFERENCE TO RELATED APPLICATIONS

The present application is a U.S. National Stage of International Application No. PCT/GB2014/052021 filed on Jul. 3, 2014, which claims the benefit of United Kingdom Patent Application No. 1312632.1 filed on Jul. 15, 2013, the entire disclosures of all of which are incorporated herein by reference.

TECHNICAL FIELD OF THE INVENTION

The present invention relates to rescue devices such as stretchers.

BACKGROUND OF THE INVENTION

A draft safety regulation requires all passenger-carrying water-based vessels to have on board rescue equipment that is suitable for the recovery of a casualty in the water, for example, in a man-overboard situation.

There are several rescue devices currently used on vessels for the purpose of sea rescue and recovery. The simplest arrangement is a scramble net comprising a web of ropes. However, such an arrangement is difficult to deploy and use in practice. Furthermore, it is recognised that to minimise the risk of post-rescue collapse and heart failure caused by a sudden drop in blood pressure, a casualty recovered from the water should be maintained in a horizontal position.

One of the most commonly used pieces of rescue equipment is the "Jason's Cradle"™, manufactured by Land and Marine Products (LMP). It enables a casualty who may be exhausted, injured or unconscious to be rescued from the sea by recovering the casualty in a horizontal position within the cradle. It can also be used as a scramble net or a stretcher. The Jason's Cradle™ is made from sections of rigid plastic that are linked together with stainless steel rods to form a grid or network. Disadvantageously, the purchase and servicing of the cradle is expensive. Furthermore, the plastic cradle is bulky and takes up a large amount of storage space. This is especially inconvenient on a small rescue boat or inflatable craft.

Alternatively the "Dacon Rescue Frame" is also used for rescue and recovery. It is made from parallel glass fibre rods connected together by lengths of webbing which lie perpendicularly to the rods. The lengths of webbing are made from a flexible material, which is fastened to the rods using metal rivets.

Stretchers are also commonly used rescue devices. The Neil Robertson Stretcher, currently used by the Royal Navy and NATO, was devised in the early 1900s. It is manufactured using canvas and wooden battens. Unfortunately, the device is susceptible to mildew and also rot in damp conditions (e.g. on-board a boat), and the canvas can be difficult to clean after use.

Stretchers are widely used at sea and on land. For example, Fire and Rescue services use stretchers to transport casualties, and the military also uses stretchers to transport injured military personnel and civilians. A problem with currently used stretchers is that they are large, bulky and unwieldy in small spaces. This means that they are difficult to transport and handle.

A particular problem faced by military patrols is that they cannot take stretchers with them because they cannot be easily transported. Thus, when a stretcher is needed, the patrol must wait for a stretcher to be delivered, for example, by helicopter, before the casualty can be moved. This means that there is a potentially significant time delay before the casualty can be moved, which can result in patrols being exposed to dangerous situations for longer than necessary. Not only does this lead to an increase in the risk of further casualties, but it increases the time before the casualty can be given proper medical care. A vehicle (e.g. a helicopter or a quad bike) on the ground has to be protected and a medical team with a stretcher has to be deployed. Time on the ground is therefore critical.

Fire and Rescue services often have to move casualties using stretchers, for example, from a house. In such cases, it is desirable to move the casualty as quickly as possible so as to remove them, and the rescue workers, from a dangerous situation. Stretchers currently in use by Fire and Rescue services are large and unwieldy and are difficult to manoeuvre in the restricted confines of a house or flat. This may lead to an increase in the amount of time that the casualty and rescuers are exposed to a dangerous environment.

Alternatives to the traditional rigid stretchers discussed above include hammock-type stretchers. Typically, these stretchers are made of a single sheet of material with few rigid elements, meaning that the stretcher can be folded up into a package which occupies relatively little space. This enables the packaged stretcher to be carried, for example, in a rucksack and taken on expeditions in the event that a member of the expedition becomes injured and is no longer able to walk. Of course, this often requires the separate unpacking and insertion of load-bearing rods before use. Some embodiments negate the requirement of inserting the rods by providing hammock-type stretches without insertable rods.

While the hammock-type stretcher may be adequate for transporting a casualty with minor to moderate injuries, such as sprained ankles or broken legs, they are unsuitable for transporting casualties with serious and potentially life threatening injuries. It is essential that a casualty with a suspected spinal injury is transported in such a way that supports the spine and minimises the movement of the casualty to minimise the risk of exacerbating any injury to the spine. It is believed that rigid stretchers are able to provide the required level of support. Therefore, it would be desirable to have a stretcher that is not only capable of being neatly packaged into a small space but also is rigid when deployed.

WO 2009/010777 discloses a device for recovery of a casualty comprising a plurality of rigid rods encased within a sheath made from tubular fabric and a plurality of linking webbing elements.

The present invention seeks to alleviate some or all of the disadvantages associated with some or all of the currently available rescue devices, particularly stretchers.

SUMMARY OF THE INVENTION

The inventors have surprisingly found that light-weight, folding rescue devices can be made by the use of a plurality of rigid rods encased in tubular sleeving, where the rods connect together, and the linking elements are secured to the tubular sleeving.

Throughout this disclosure the rods are said to be able to be disconnected, separated or disengaged from each other. It should be noted that this term not only applies to rods being completely separated from each other, but also to partially disconnected rods, wherein they are able to rotate relative to each other, either when they are ultimately still connected directly, or connected indirectly by a flexible member, such as an elastic cord, cord, rope or wire etc. Therefore, when it is said that the rods are disconnected in this disclosure, it also describes the situation where two rods are not themselves in direct contact, but are still connected by a third member According to the present invention is a rescue device comprising: at least two collapsible columns defining a core section, with each collapsible column lying adjacent to at least one other column; and at least one linking element, wherein each collapsible column comprises: a plurality of rods, connection means; and at least one sleeve, wherein each rod is located within a sleeve, the plurality of rods are connectable in series by the connection means to form a collapsible column, and each sleeve is connected to at least one other sleeve by attachment to the at least one linking element.

Connection means as described herein may relate to any device capable of connecting the multiple rods as described herein. As such, the terms connection means and connection device can be used interchangeably.

The present invention therefore provides a device wherein the central supporting members—the columns—can be at least partially dismantled and folded. The device can be stored in a folded, and therefore compact arrangement, allowing it to be transported more cheaply and easily, as well as allowing it to be transported or taken with users when it would not previously have been possible, for example the military could take the device on patrol with them, where previous devices would not be so portable.

Some devices according to the present invention, once they have been assembled, need to be sent to a specialist unit to be cleaned, inspected and repackaged. This is similar to the system currently used for parachutes. This may be due to the tension in the biasing means being too strong to overcome in the field. In other scenarios, the stretcher may simply be discarded.

Other devices according to the present invention are entirely reusable, wherein the device can be easily deployed and folded up again by a pair of users. Further, some embodiments according to the present invention may be deployed and then folded up again by a single user.

Unless stated otherwise, a rod according to the present disclosure comprises a generally elongated body of any cross-sectional shape or size. In particular embodiments of the invention, the rods are circular in cross-section. However, the rods may have an oval cross-section.

The present invention is preferably for use on a subject that is human. In alternative embodiments of the present invention the subject may be an animal.

In the following discussion, the terms columns and core section can be used largely interchangeably unless stated otherwise. As can collapsible columns and columns.

Preferably, the at least two collapsible columns are substantially parallel to each other.

Preferably, the device comprises more than one linking element. However, a device comprising only one linking element is possible, and may be achieved by having a single linking element traversing the width of the core section multiple times by extending from one side of the core section to the other and back again and thus connecting all of the columns. For example, a single linking element may be in the form of a zigzag, "S" shape or an "8" shape, each shape allowing a single linking element to provide support and stability over the entire length of the core section.

Preferably, the core section, and hence the at least two collapsible columns, are located substantially along a centreline of the device. As such, preferably, a subject to be carried lies directly or indirectly on the core section during use. When the device is used with people and most animals, this ensures the present invention provides ample support to the spinal area of the subject.

Preferably, the at least one linking element is arranged substantially perpendicularly to the columns. The linking element may maintain a maximum spacing of the columns. The required spacing of the columns depends upon the intended use for the device. Heavier subjects may require more, closely spaced, columns, whereas a larger spacing may be sufficient for lighter subjects.

In embodiments of the invention, the at least one linking element and/or sleeves are flexible. In a preferred embodiment, the sleeves and/or sheaths (see below) are stitched, bonded or welded to the linking element.

In certain embodiments of the invention, the rods may be hollow. Hollow rods can reduce weight while maintaining a high bending strength. However, solid rods are also anticipated as falling within the scope of the present invention.

In preferable embodiments of the invention, the connection means comprises a spigot and socket arrangement on each of the plurality of rods. Many other connection means are also possible, however, such as a simple outer sheath or ferrule to hold the two ends of the tubes in an abutted arrangement. Other example connection means included within the scope of this invention include simple screw hinges, whereby the ends of the two rods are flattened off and abutted with a bolt passing through both surfaces, perpendicular to the axis of the rod. With a nut on the other side of the bolt, the two rods can be fixed relative to each other or allowed to rotate relative to each other. In this embodiment, the nut and bolt can be removed and the two rods can be separated. A further example of a connection means would be a simple clip to connect two rods together or a screw in one rod with a corresponding thread in the abutting rod. Other connection means suitable for the present application will be apparent to the skilled reader.

Preferably, the connection means further comprises at least one biasing means. As used herein, the term biasing means may be used interchangeably with biasing device. In preferred embodiments, the biasing means is an elastic elongated biasing means.

Preferably each collapsible column comprises a top end and a bottom end and the biasing means comprises a corresponding top end and bottom end attached to the top end and bottom end, respectively, of each collapsible column Preferably each of the plurality of rods are hollow and the biasing means runs through the hollow rods.

Such a biasing means applies a tension force along the length of the column, forcing the rods together and maintaining them in an engaged and connected arrangement, when in use. Alternatively a non-elastic biasing means may be used, in combination with a device to induce and reduce tension attached to one end, as discussed below. Alternatively, a plurality of elastic or non-elastic biasing means may be included, with up to one biasing means per connection means. It is anticipated that multiple different biasing means may be used in a single column, with different strengths. As such, certain connection means may be more easily disconnected than others, allowing certain sections of columns to fold down during use, while others can not. The biasing means may simply comprise an individual spring located in the region of the connection means, with one end of the spring connected to each neighbouring rod respectively. The spring may coil around the rods to provide a compact arrangement.

The biasing means provides the advantage that it acts as a guide for connecting the rigid rods, thus facilitating the assembly of the rescue device. A biasing means provides the additional advantage that the rigid rods are connected to one another by being drawn together by the biasing means, rather than having to be pushed together by hand. Thus, the biasing means provides for easier and faster assembly of the rescue device. In some cases, the biasing means can be strong enough to result in the device being automatically deployed upon release of a catch or strap on the folded device. The biasing means are sufficiently strong to actuate the rods to align and engage without any input from the user.

Preferably, the top and/or bottom end of the biasing means is held, fixed or restrained relative to the collapsible column by a stopper. The biasing means needs to be anchored, to allow tension to be transferred to the column and to prevent one end of the biasing means being pulled through the column, releasing the tension. In further embodiments, both ends of the biasing means are anchored by a stopper. Alternatively the biasing means is folded, and so extends along the length of the column twice, requiring only one stopper anchoring both ends of the biasing means, and a hook or other attachment to loop the biasing means over at the other end of the column.

A jamb cleat may be attached to the top and/or bottom end of the collapsible column to restrain the corresponding top and/or bottom end of the biasing means, with a stopper at the other end if required. Other, equivalent, components capable of fixing the end of an elastic cord or string, while still allowing the tension to be released when required will be apparent to one skilled in the art. Potential examples include a small winch or a simple toggle (e.g. a single hole toggle or a two, three or four hole toggle). With the correct choice of elongated component material, a means of adjustment may not always be required. A means of adjustment is preferable as it allows a user to more easily re-fold the device after use, without the need for specialised equipment or plenty of space and a second person to overcome the tension force of the biasing means. This is possible as the tension can be released by use of the jamb cleat or equivalent, wherein a user is able to easily disengage the rods, and fold the columns. It will be appreciated that one jamb cleat and stopper can be used in combination.

Preferably, at least one of the at least one linking elements extends out from both sides of the core section.

Preferably, an extension strap, suitable for wrapping around a subject lying on the cores section when in use, is connected directly or indirectly to the core section of the device, or to a or multiple linking elements, or to the outermost column, and the extension strap comprises one half of a securing mechanism which mates with the other half of a securing mechanism attached to an extension strap connected to the other side of the core section. Preferably there are at least two extension straps. Preferably there are 4 or more extension straps. Preferably the extension straps are connected symmetrically on either side of the device. The length of the extension strap must be suitable so the two halves of the securing mechanism can meet. This means that the length of extension strap required will vary in accordance with the position of the extension strap and the subject to be carried. For example, for use with a human, some sections, such as that corresponding to the location of the patient's ankles, will only require a short section, while longer sections will be required at the patient's chest. Alternatively, an extension strap on one side of the core section may be of sufficient length to reach almost entirely around the subject, therefore allowing the extension strap on the other side of the core section to be of a shorter length, or absent entirely. In such an embodiment, the complementary half of the securing mechanism may be connected directly to one of the at least one linking elements, outer columns or core section.

It should be understood that where it is said an extension strap is required—and in many embodiments the extension strap will be a separate component attached to a linking element, or directly to the core section itself—it is not necessarily so. The extension strap may simply be a section of the linking element that extends out from the core section or any other panels (if present).

Preferably the securing mechanism is a quick release buckle. With such a securing mechanism the extension straps only need to meet once in an in-use position. However, in some embodiments the extension straps on opposing sides must be long enough to overlap somewhat. Such an overlap may be required when the securing mechanism is other than a quick release buckle. For example, other potential securing mechanisms include: Velcro™, poppers, buttons, a cam buckle and strap or simple fastening ties. In some of these examples (for example with Velcro™) the extension straps will need to be longer to allow the panels to be wrapped one over the other and the Velcro™ fastened together in order to secure the subject on the rescue device.

Preferably, there are two or more of these extension straps and linking element combinations. Preferably there are four or more. More preferably there are at least five.

Preferably, the combined length of at least one set of two extension straps and the linking element to which they are attached is between 500 and 3000 mm, more preferably between 800 and 2500 mm, most preferably between 1000 and 1500 mm.

In certain embodiments, at least two linking elements have an extension strap extending out from either side of the device, the extension strap comprising one part of a quick release buckle for mating with the complimentary part of the quick release buckle on the extension strap on the other side of the device. More preferably four linking elements have extension straps, more preferably five or more linking elements have extension straps.

In further embodiments, a variety of different circumferences may be enclosed by relative pairs of extension straps when the securing means are secured. When used herein, the term securing means may be used interchangeably with securing device. This ensures support is provided along the entire length of the device. Preferably the extension straps comprise cam buckles or other equivalent means to allow the length of the extension strap to be adjusted by the user.

In yet further embodiments, there may be a number of sets of extension straps and linking elements, and the combined lengths of these sets of extension straps and linking elements increases as they get further away from the lower end of the device, corresponding to where a patient's feet would be if the device is for use with humans.

Preferably, at least one handle is attached to the core section of the device so that the tension exerted by the handles maintains the columns at their maximally spaced configuration. In further embodiments, at least one handle may be attached symmetrically either directly or indirectly to the linking elements or outermost columns on either side of the device so that, in use, the tension exerted by the handles maintains the columns in their maximum spacing configuration. This tension exerted either on the linking element or the outermost columns will pull the columns apart. This will increase the useful surface area of the columns, ensuring the area capable of supporting the patient is maximised.

Preferably the handle is made out of a strap. Alternatively, rigid handles could be attached. Suitable materials for both flexible and rigid handles are discussed below.

The handles may not be attached to the columns directly or indirectly, and instead simply form a support which runs from one side of the device to the other, under the columns, thus supporting their weight and that of the subject.

Rigid handles may be attached to the columns or linking elements as described above, or alternatively may be attached to the lower and upper ends of the device. Such a minor modification is not seen as significant, and such an embodiment is still felt to be within the scope of the present invention. In such an embodiment, the weight of the subject would be sufficient to maintain the spacing of the columns.

At least one rigid member may be connected to the linking elements. Preferably the at least one rigid member is connected to the at least one linking element extending out from both sides of the core section. The rigid members may be elongate and may comprise a solid core and a flexible outer sheath. The rigid members are similar in appearance to the columns, and may run substantially perpendicularly to the linking elements. That is the rigid members may be parallel to the columns. Alternatively, the rigid members may be at a slight angle to the columns. Preferably, the rigid members are located substantially parallel to the columns, and to the side thereof.

In certain embodiments of the invention, the rescue device further comprises a panel, which comprises a plurality of rigid members located symmetrically on either side of the core section. The panel may be placed adjacent regions of the core section where additional support or protection might be required on the side or top of a subject. For example, when used for a human casualty, a side panel is preferably located in the region where the casualty's legs would be. This panel can then fold/wrap around the patient's legs, providing support and protection.

In further embodiments, at least one extension strap and securing mechanism are attached, symmetrically, on these panels. Preferably, these panels are rotated around to lie on top or to the side of the subject during use, once the securing mechanism is engaged. The plurality of rigid members may be arranged at a slight angle to the core section. This allows the panels to provide support closer or further away from the core section when secured. For example, when the device is for use with a human patient there may be provided a smaller gap between the panel and the columns at a location adjacent the patient's feet, and a larger gap between the panel and the columns at a location adjacent the patient's thighs. Preferably these panels restrain and protect the patient's legs.

The panels may comprise any number of rigid members in any arrangement. A preferable arrangement is where a panel comprises four rigid members in two rows of two.

The subject may be an animal. In which case, the panels may require a different arrangement.

When used by the military in the field, a device may be used wherein each connection means has an independent biasing means or alternatively, the rods towards the bottom end of the stretcher have an independent biasing means in relation to the other rods, thus allowing them to be folded back. In these embodiments, the biasing means attached to the connecting rods where the casualty's legs will be (the 'lower' rods) may be of a lower strength than those connecting rods in the location where the patient's head will be. This will allow the lower rods, and hence lower section(s) of the core section to be disconnected, and folded down under the stretcher easily in the field, to provide access to certain wounds. In such embodiments, the retracted lower section(s) are held in place by a restraining means. Such embodiments would be of particular use when the subject is an amputee, as the lower panels can be folded back, allowing better access to the wound.

In an alternative but similar embodiment, a single biasing means spans each entire column but the stretcher is still suitable and adaptable to be used with amputees. In such embodiments, the tension in the biasing means is released to allow the lower rods to be disengaged from the rest of the column, folded under and fixed on the underside of the core section. The biasing means is then retensioned, with the lower rods withdrawn.

When used herein, the term restraining means may be used interchangeably with restraining device.

When in use with large animals, either alone or combined with a hammock-type device, the number of rigid members and/or columns required may be substantially increased to allow the panel to protect a much larger area, e.g. the abdomen of a horse. When used with animals, significant other modifications will be required, for example the location and length of a panel or the panels will need to be modified to ensure there is ample support for the animal. Additional modifications such as the width and length of the core section may be required. A horse has a significantly larger abdomen, and so a core section of ten, fifteen or maybe twenty columns may be required. A further panel may be required adjacent the equivalent of the upper end to restrain the horse's neck and head.

Two or more of the at least two rigid members may be located end to end, and may be connected by a section of empty flexible sheath. As such, preferably, the rigid members have a section of solid core missing in-line with and adjacent any connection means of the rods, allowing the rigid members to bend about this section. When used in relation to the rigid members, core section or the device as a whole, the terms bend and fold are used interchangeably unless stated otherwise. Preferably, the sheath is flexible. Preferably, the sheath is continuous over the section without a solid core, and allows the rigid member to bend about this point. Preferably, these bending locations allow the rigid members and the tensioning panels made thereof to bend about the same axes as the columns. For example, in certain embodiments, the bending or folding locations may be located adjacent connection means. Preferably, the section of empty flexible sheath is adjacent to an abutment of two rods. The sheaths extend continuously for the length of the panel, without a break between the solid core sections, thus flexibly connecting the two rigid members.

Gap regions (where no solid core is present) may be required in any and multiple locations on any present panels.

Preferably, each sheath of the at least one rigid member has two flanges extending radially outwards from the solid core. Rigid members, unlike rigid rods of the core section preferably do not comprise spigots and sockets, and are not adapted to connect to each other in series to form sections As such, modifications as described above may be required to allow the rigid members to bend where required when the rescue device is to be stored.

Alternatively, further rod and sleeve combinations may be present in side panels, instead of rigid members. These further "side columns" will then need to have their connection means aligned with those of the core section, to allow the whole device to bend about an axis or multiple axes.

Preferably, the sleeves and/or sheaths are attached to the at least one linking element by stitching or welding. Preferably the flanges of the sleeves and/or sheaths are attached to the at least one linking element. Other attachment means will be apparent to the skilled reader, and may include alternatives such as adhesives, rivets, staples and other mechanical fixing means. These fixing means can be used in relation to sleeves, sheaths, flexible handles and linking elements of the present invention. In embodiments wherein the sheaths comprise a flange, the stitching advantageously comprises a row of stitching that is continuous along the length of the flange. Alternatively, the stitching comprises zig-zag stitching spanning the depth of the flange. This can also apply to the sleeves of the rigid rods in the core section, as well as connections between flexible handles and linking elements.

Examples of materials suitable for use for flexible components described herein (including, but not limited to the sleeves, sheaths, handles and linking elements) include, but are not limited to: a coated material, PVC coated material (e.g. PVC coated polyester), Teflon coated fabric, woven material (e.g. webbing), multifilament synthetic material, meta-aramid material, fabrics produced from fibres selected from polyamides such as Nylon, modacrylics (modified acrylic made from acrylonitriles), polyolefins, acrylics, polyesters, aramids (e.g. meta-aramids such as Nomex™, Kevlar™ or Twaron™, synthetic and semi-synthetic celluloses such as Modal or Lyocell, PBIs (polybenzimidazoles), polylactide types, and any other kind of polymeric material used in the manufacture of fibres. Any of these may be used alone or in combination, optionally with one or more fibres to add to tensile strength such as glass fibre or carbon fibre. Specific examples include: a meta-aramid material, especially Kevlar™ or Nomex™.

Examples of materials suitable for use for rigid components described herein (including, but not limited to the rods, solid cores and any rigid handles) include, but are not limited to: polymer, composite material, such as carbon fibre, metal or any other suitable rigid material. In some embodiments, the rigid rods or the solid core of the rigid members may be made of moulded or thermoformed Polycarbonates, carbon fibre composites, glass fibre composites or Technora™. In preferred embodiments carbon fibre is used.

Conveniently, the rigid rods or rigid members may be made from the same or different materials.

The device can be put in a folded configuration when the tension in the connection means of the series of rods has been released, allowing the columns to fold about the location of the connection means.

According to a further aspect of the present invention is a method of storing a rescue device, wherein the connection means are disconnected, allowing the at least two columns to be folded back on themselves about the connection means.

Preferably, where a biasing means is present, and particularly when an elastic elongated biasing means is present, the method of storing a rescue device may comprise a restraining means.

Preferably, a number of rods can be disconnected from the rest of their column and folded over, to reduce the size of the core section, allowing better access to certain parts of amputees when used by the army in the field. Preferably this provides for just a single section (e.g. the lower quarter) of the core section being disengaged and folded away, while the rest of the core section (e.g. the upper three quarters of the columns) is maintained in a rigid, collinear and engaged state.

Due to the modular nature of the above-described invention, the number of rods, columns, linking elements, panels and rigid members can vary while still being according to the present invention. Little restriction is placed on the number of components, apart from cost.

The more columns present, the lower the stress will be on individual columns, leading to a spreading of load and increase in comfort. As such, the device may comprise more than two columns. There may be as few as two columns. Preferably there may be four or more columns. For example, there may be up to ten columns. The principles of the construction and use of the invention is independent of the number of columns. As such, the same design, manufacturing and use considerations and approaches are equally applicable to a design with any number of columns. As such, a vastly different sized device, with a different number of columns can be produced with according to the present invention.

The more linking elements present, the less load individual elements have to carry and hence the smaller individual linking elements can be, or a wider variety of materials can be used for the linking elements. As such, preferably at least three linking elements are present. More preferably there are between three and ten linking elements. Alternatively there may be more than ten linking elements. Again, the same design, manufacturing and use considerations and approaches are equally applicable to a design with any number of linking elements. As such, a vastly different sized device, with a different length of column and number of linking elements can readily be produced according to the present invention.

The more rods present, the higher the degree of flexibility in terms of packing and folding arrangement. However, the higher the number of rods, the longer it will take to assemble the stretcher if done by hand, and the more interconnections there are that might fail. Preferably, each plurality of rods (e.g. a column) comprises from two to ten rods connected in series. More preferably, each plurality rods comprises four rods connected in series. Alternatively, there may be between five and ten rods per column, or even over ten rods per column, enabling a very dense packing arrangement. Again, the same design, manufacturing and use considerations and approaches are equally applicable to a design with any number of rods. As such, a vastly different sized device, with a different length of column and rod can readily be produced according to the present invention.

Preferably, the total length of the columns, when all the rigid rods are in series, is over 500 mm, more preferably between 800 and 2500 mm, most preferably between 1200 and 2200 mm.

Preferably, the width of the core section is between 150 and 2000 mm, more preferably between 150 and 1000 mm, and most preferably between 250 and 500 mm.

Additionally, vastly different shaped devices, for a variety of subjects can be achieved according the present invention, by modifying the number and length of the columns, linking elements and rigid members.

These and other features of the present invention will now be described, by way of example only, with reference to the accompanying drawings.

DETAILED DESCRIPTION OF PREFERRED EMBODIMENTS

Figures 1, 2:
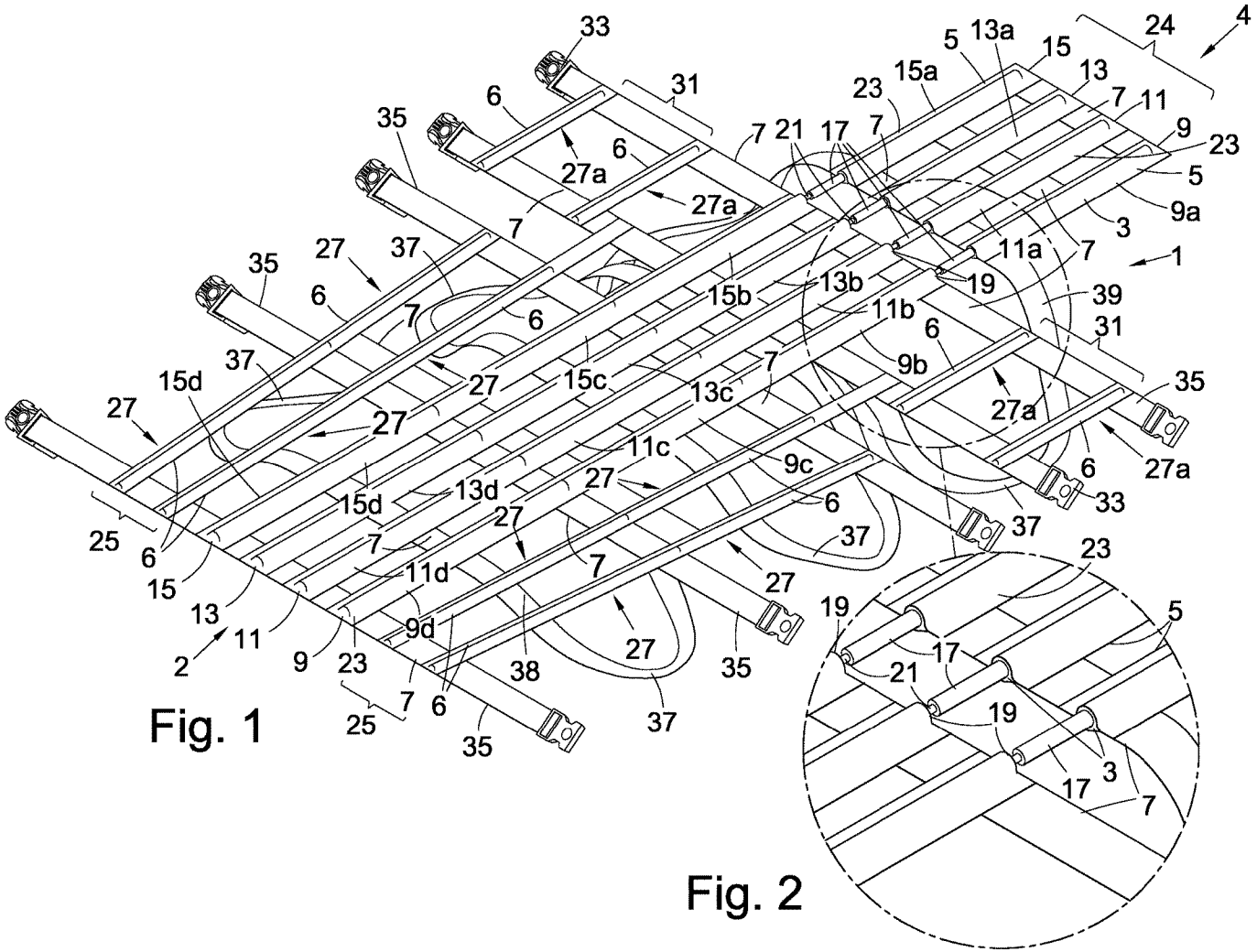
FIG. 1 shows a perspective view of an embodiment of the present invention.
FIG. 2 shows an enlargement of part of the embodiment of the invention of FIG. 1.

In a first embodiment of the present invention, as exemplified in FIGS. 1 and 2, there is provided a folding rescue device 1 comprising a core section 24, two wing panels 25 and two mid-panels 31. The wing panels 25 and mid-panels 31 are collectively referred to as side panels.

The core section 24 comprises a plurality of rigid rods 3 (each rigid rod 3 being encased in a non-rigid tubular sleeve 5), with a plurality of non-rigid linking elements 7 lying perpendicular to, and intersecting the rigid rods 3. In the depicted embodiment, the rods have a circular cross-section, which allows the rods to be spiral-wound. In alternative embodiments, the rods may have any cross-section, for example, a triangular, a square or an oval cross-section.

As depicted in FIG. 2, the rigid rods 3 are hollow tubes. Although hollow in this embodiment, the rods may also be solid. Each rod 3 is capable of being connected to an adjacent rod. Thus columns of rods in series can be formed. In the embodiment shown in FIG. 1, there are four columns 9, 11, 13, 15. Embodiments according to the present invention could have two or more columns, for example up to six, eight or even more columns.

In the currently depicted embodiment of FIGS. 1 and 2, each column comprises four rigid rods 3 in sleeves 5, positioned in series. The combination of a rigid rod 3 in a sleeve 5, corresponds to a quarter of a column in the depicted embodiment and is referred to hereinafter as a "column component". Alternative embodiments may use different numbers of rods per column, for example two, three, five or more. The columns 9, 11, 13, 15 are positioned parallel and adjacent to each other. Each rod 3 is located within a sleeve 5, although in other embodiments multiple rods may be located within a single sleeve, and there may only be one sleeve per column. In the present embodiment, as depicted in FIGS. 1 and 2, there is one sleeve per rod. Each column 9, 11, 13, 15 is formed by four rods 3 located within a corresponding sleeve 5. When the rods 3 are connected end to end, the resulting column gives the impression of one continuous sleeve.

As can be seen in FIG. 2, one end of each rigid rod 3 comprises a spigot 17 and an adjacent end of the next rigid rod 3 comprises a socket 19 for receiving the spigot 17. Thus, adjacent rigid rods 3, arranged in series, can be connected end-to-end by inserting the spigot 17 of one rigid rod 3 into the socket 19 of an adjacent rigid rod 3. In the present embodiment the spigot 17 and socket 19 act as the connection means. Many other connection means may be used in alternative embodiments of the present invention. For example the rod-ends may have complimentary screw and threaded-socket components, there may be interlocking nut and bolt components or the two rod ends may be identical and both slot into an external wrap or ferrule, maintaining the two ends in an abutting and collinear arrangement. Alternatively, a plurality of external clips, where each clip fastens two rigid rods together, may be used.

The embodiment of FIG. 1 further comprises a biasing means 21 which passes through the lumen of the hollow rigid rods 3. The biasing means 21 of FIG. 1 is an elastic shock cord and the depicted embodiment comprises one shock cord 21 per column 9, 11, 13, 15. Thus, the tension exerted by the shock cord draws the spigots 17 of the rigid rods 3 into the sockets 19 of the adjacent rigid rods 3 and helps maintain the spigots 17 in this position during use. A stopper (not shown) is threaded onto each end of the shock cord 21 and held, fixed or restrained relative to both ends of each column 9, 11, 13, 15. As such, a stopper is located at the upper end of column components 9*a*, 11*a*, 13*a* and 15*a*, and at the lower end of column components 9*d*, 11*d*, 13*d*, 15*d*. Each end of the shock cord 21 is knotted adjacent to or around the stopper, in order to prevent the entire shock cord 21 from being drawn into the lumen of the hollow rigid rod 3. In alternate embodiments, the shock cord may be substituted with an elastic cord or a bungy cord.

In the present embodiment, this may result in a user being unable to reduce the tension in the biasing means in the field. As such, once the rescue device has been deployed the user may be unable to disconnect the rods to return the rescue device to a folded state. The user may therefore discard the stretcher or send it away to a facility able to reduce or overcome the tension and re-fold the stretcher for re-use.

In other embodiments, one end of the biasing means may comprise a jamb cleat in order to allow the tension in the biasing means to be adjusted. The jamb cleat is located at one end of the biasing means, replacing one of the stoppers, and is held, fixed or restrained relative to the rod on which it is attached. The jamb cleat allows a user to tension the biasing means, but then to release the tension when the rescue device needs to be folded up again. Alternative embodiments may make use of other biasing means, such as springs between the rods.

The linking elements 7 are arranged perpendicularly to the rigid columns 9, 11, 13, 15. The linking elements extend the entire width of the rescue device 1 and are secured to the sleeves 5. In this embodiment, the linking elements 7 are made of webbing, the sleeves 5 are made of PVC coated polyester fabric and the rigid rods are made of carbon fibre composite which, for example, may be wound, braided or extruded. However, in alternate embodiments, other materials may be used.

Examples of alternative materials for the sleeves 5 (and sheaths 6, see below) include, but are not limited to, coated, materials, PVC coated material (e.g. PVC coated polyester), Teflon coated fabric, and fabric (e.g. webbing) woven from multifilament synthetic material, meta-aramid material, fibres selected from polyamides such as Nylon, modacrylics (modified acrylic fibers made from acrylonitriles), polyolefins, acrylics, polyesters, aramids (e.g. meta-aramids such as Nomex™, Kevlar™ or Twaron™), synthetic and semi-synthetic celluloses such as Modal or Lyocell, PBIs (polybenzimidazoles), polylactide types, and any other kind of polymeric material used in the manufacture of fibres. Any of these may be used alone or in combination, optionally with one or more fibres to add to tensile strength such as glass fibre or carbon fibre. Possible examples include a meta-aramid material, especially Kevlar™ or Nomex™.

Alternative materials which may be used for the rigid rods 3 (or rigid members 27, see below) include polymer, composite material, metal, a fibre, such as carbon fibre, or any other suitable rigid material. In some embodiments, the rigid rods or the solid core of the rigid members may be made of moulded or thermoformed Polycarbonates, carbon fibre, glass fibre or Technora™. In preferred embodiments carbon fibre is used.

Conveniently, the rigid rods or rigid members may be made from the same or different materials.

The sleeves 5 comprise flanges 23 extending radially outwardly from the rigid rod, and the linking elements 7 are secured to the flanges 23 of the tubular sleeves 5 by stitching or welding. As such, the combination of the sleeves 5 and linking elements 7 produce a grid-like effect from above.

The four columns of rigid rods 9, 11, 13, 15 form a core section 24 of the folding rescue device 1. In the embodiment of FIG. 1, the four sets/columns of rigid rods are arranged in parallel every 30 cm. Alternatively, the core area can comprise between two and eight sets of rigid rods spaced at intervals ranging from every 15 cm to every 60 cm. The sets of rigid rods can be of a uniform length of 2 m, but the length can preferably range between 1.2 m and 2.5 m. However, the sets of rigid rods are obviously not constrained to be within this range of lengths.

The lower-left end of the device as illustrated in FIG. 1 is defined as a lower end 2. The opposite end is defined as an upper end 4. At the lower end 2 of the folding rescue device, wing panels 25 are arranged symmetrically on either side of the core section 24. Each wing panel 25 comprises four rigid members 27 in two rows of two. The rigid members 27 are at a slight angle to the columns 9, 11, 13, 15 so that the end of the rigid member adjacent the connection between the middle two column components 9*b* and 9*c*, is located further from the centre-line of the core section 24 than the end nearest the lower end 2 of the rescue device 1. Other embodiments may require alternative arrangements, depending on the use of the device. For example, the present embodiment is intended for use with humans as subjects. As such, the arrangement of the wing panels 25 is such that upon engaging quick release clips 33 (discussed below), the wing panels 25 are covering and supporting a portion of the casualty's legs.

In the present embodiment, adjacent the column components second closest to the upper end 9*b*, 11*b*, 13*b*, 15*b*, there is a mid-panel 31 located symmetrically on either side of the core section 27, comprising two adjacent and parallel rigid members 27*a*. The rigid members 27*a* are the same as those of the wing panels 25, except shorter in length. The rigid members 27*a* of the mid-panels 31 are connected to the core section 24 by the linking elements 7 in the same way as described for the wing panels 25, and are arranged in parallel with the rigid rods 3 of the core section 24.

In alternative embodiments, the subject may be an animal. In such embodiments, the wing panels 25 may require a different arrangement. When in use with large animals, the number of rigid members 27 required in a direction perpendicular to that of the columns 9, 11, 13, 15 may be substantially increased to allow the wing panel 25 to protect a much larger area, e.g. the abdomen of a horse. When used with animals, significant other modifications will be required, for example the location and length of the wing panel 25 and mid-panel 31 will need to be modified to ensure there is ample support for the animal. In some situations, the mid-panel 31 (used to go under the arms of a human patient) may be omitted, with a single, long wing panel 25 included instead. Additional modifications such as the width and length of the core section 24 may be required. A horse has a significantly larger abdomen, and so a core section 24 of ten, fifteen or maybe twenty columns may be required. A further panel may be required adjacent equivalent of the upper end 4 to restrain the horse's neck and head.

In the present embodiment, each rigid member 27 comprises a solid core encased within a sheath 6 of tubular flexible material. Each sheath 6 has two flanges extending radially outwards from the solid core. The rigid members 27 of the wing panels 25, unlike the rigid rods 3 of the core section 24 do not comprise spigots and sockets, and are not adapted to connect to each other in series. As such, modifications are required to allow the rigid members 27 to bend where required when the rescue device is to be stored. This is achieved by having a gap between the ends of the two solid core sections in each pair of aligned rigid members 27. In this embodiment the gap is located adjacent the connection between the two column components nearest the lower end 2 (9*c* and 9*d* etc). In this gap region, no solid core is present, and so the gap is bridged solely by flexible sheath. This gap allows the wing panels 25 to bend about the gap region. The sheaths 6 extend continuously for the length of the wing panel 25, without a break between the solid core sections, thus flexibly connecting the two rigid members 27.

In other embodiments gap regions (where no solid core is present) may be required in different locations on the wing panel 25, in some embodiments multiple gap regions may be required depending on the configuration of the various panels. Gap regions are required in the wing panels where rigid members 27 are present, and an axis is required about which the wing panel 25 must be able to fold or bend. In further embodiments, the wing panels 25 may comprise columns similar to those used in the core section 24 of the present embodiment Like with the sleeves of the columns 9, 11, 13, 15, the linking elements 7 of the present embodiment are secured to the flanges of the sheaths by stitching or welding. As such, the combination of the sheaths and linking elements 7 produce a grid-like effect from above.

The linking elements 7 extend across the entire width of the core section 24 and side panels 25, 31 (wherein the side panels comprise the wing and mid-panels). Some linking elements 7 comprise an extension strap 35 which extends beyond the outermost rigid member 27 of each panel 25, 31. These extension straps 35 are attached to quick release buckles 33 to enable the subject to be carried to be secured into the rescue device 1 during use. The extension straps 35 can simply be extensions of the linking elements 7. The extension straps 35 or linking elements may comprise adjustment means to allow a user to adjust their length.

In use, the subject is positioned on the rescue device 1 so that one end of their body is at the lower end 2 of the rescue device 1 with the other end at the upper end 4. In the present embodiment, a casualty's feet will be located and secured at the lower end 2, with the casualty's head at the upper end 4. In other embodiments, an animals head may be at the upper end 4, and their tail at the lower end 2.

In the present invention the panels 25, 31 are folded around the casualty to rest on the sides/top of the casualty. The extension straps 35 then traverse the gap between the panels 25, 31, and quick release buckles 33 are fastened together to secure the casualty in the rescue device 1. In other embodiments, other securing means can be used. For example, Velcro™, poppers, buttons, a cam buckle and strap or simple fastening ties. In some of these examples (for example with Velcro™) the extension straps 35 will need to be longer to allow the panels 25, 31 to be wrapped one over the other and the Velcro™ fastened together in order to secure the casualty on the rescue device.

In the present embodiment, the angle of the rigid members 27 in the wing panels 25 at the lower end 2 of the rescue device 1 in relation to the columns 9, 11, 13, 15 of the core section 24 is such that the wing panels 25 taper in towards the lower end 2 of the rescue device 1. The shape of the mid-panels 31 allows them to be fastened under the arms of the casualty and secured around their torso. The fact that the wing panels 25 are tapered results in the stretcher being secured more tightly at the lower end 2 around a casualty's feet, and so prevents them from slipping downwards in the stretcher. This feature, and the fact that the mid-panels 31 are wrapped around the torso of the casualty, enables the casualty to be fastened securely on the stretcher. This is particularly important if the casualty has a spinal injury. For other subjects, the panels 25, 31 will be designed differently, and will be fastened around different parts of the subject as described above.

The folding rescue device 1 may further comprise handles 37 for lifting the rescue device once a casualty is secured onto it. The handles 37 may be formed by the addition of extension straps of non-rigid material 38 being secured between two linking elements 7, to form a loop that can be grasped. Alternatively, the handles 37 may be formed by the ends of the linking elements 7. The linking elements 7 may extend beyond the outermost rigid rod of the core section 24 and be fastened to a further linking element 7 to form a loop 39.

In the present embodiment, the handles 37 help maintain the spacing of the columns 9, 11, 13, 15, as the tension applied to the handles 37 pulls the non-rigid material 38 taught, and either directly or indirectly through the linking elements 7, the columns are pulled apart. The linking element 7 restricts the amount the columns 9, 11, 13, 15 can be spaced, and so the columns are maintained at a predetermined, and optimal, spacing.

In other embodiments the handles may not be attached to the columns directly or indirectly, and instead simply form a support which runs from one side of the device to the other, under the columns, thus supporting their weight.

Examples of materials for the handles when made out of a flexible material include, but are not limited to, PVC coated material (e.g. PVC coated polyester), Teflon coated fabric, and fabric (e.g. webbing) woven from materials such as: multifilament synthetic material, meta-aramid material, fibres selected from polyamides such as Nylon, modacrylics (modified acrylic fibers made from acrylonitriles), polyolefins, acrylics, polyesters, aramids (e.g. meta-aramids such as Nomex™, Kevlar™ or Twaron™), synthetic and semi-synthetic celluloses such as Modal or Lyocell, PBIs (polybenzimidazoles), polylactide types, and any other kind of polymeric material used in the manufacture of fibres. Any of these may be used alone or in combination, optionally with one or more fibres to add to tensile strength such as glass fibre or carbon fibre. Potential examples include: a meta-aramid material, especially Kevlar™ or Nomex™.

In other embodiments, however, the handles may be rigid and made out of metals, thermoset plastics, thermoplastic plastics, alloys or composites. These rigid handles may be attached to the columns 9, 11, 13, 15 or linking elements 7 as described above, or alternatively may be attached to the lower and upper ends 2, 4 of the device 1. The weight of the subject would be sufficient to maintain the spacing of the columns 9, 11, 13, 15 in this embodiment.

In other embodiments the wing panels 25 and mid-panels 31 may comprise more than two rigid members 27 arranged side by side. For example, in some embodiments there may be between two and five rigid members. In other embodiments, for example where the subjects have a large circumference that needs support, ten, fifteen, twenty or even more rigid members could be used.

Figures 3, 4:
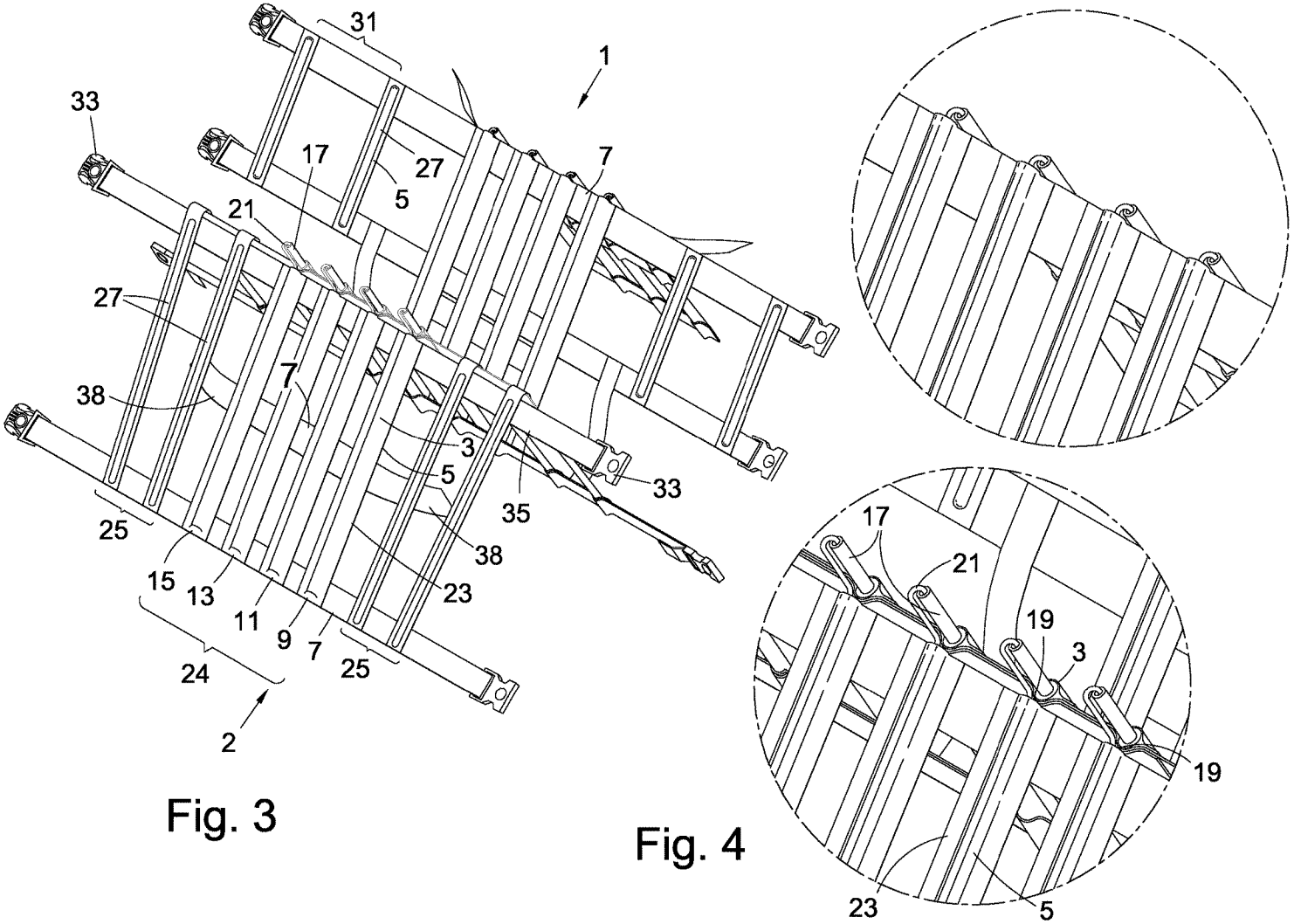
FIG. 3 shows the embodiment of FIG. 1 in a semi-folded configuration, with the handles cut away.
FIG. 4 shows an enlarged view of the spigot and shock cord assembly of the embodiment of FIG. 3.

FIG. 3 shows the folding rescue device of FIG. 1 in a semi-folded configuration, with the handles cut away, and FIG. 4 shows an enlarged view of the spigot 17 and shock cord 21 assembly. As can be seen from FIG. 4, the spigots and elasticated shock cord 21 allow for rapid and easy assembly of the rescue device 1 from its folded configuration. The tension of the elasticated shock cord 21 causes the spigoted end 17 of one rigid rod 3 to be drawn into the socket 19 of the next rigid rod 3. The tension in the shock cord 21 keeps the spigoted end 17 within the socket 19 during use of the rescue device 1. FIG. 3 illustrates the method of folding the device 1. For disassembly of the device 1, the rods 3 must be disengaged from one another by removing the spigot 17 from the socket 19 of adjacent rod 3. The two rods 3 are then free to rotate relative to each other, and the entire device 1 can be folded up. In embodiments comprising a jamb cleat at one end of the shock cord 21, the jamb cleat may be undone to reduce the tension in the shock cord in order to make disassembly easier.

FIG. 3 also demonstrates the role of the gap between the solid cores of aligned rigid members 27 in the wing panels 25. The gaps and flexible sheaths 6 act as a folding region. The wing panels 25 can then fold in a location adjacent the spigot 17 and socket 19.

In a preferred embodiment, the column components (9*d*, 11*d*, 13*d*, 15*d* of the present embodiment) nearest the lower end 2 are easily disconnected from their adjoining column components (9*c*, 11*c*, 13*c*, 15*c* of the present embodiment) while the rest of the column components (9*a-c*, 11*a-c*, 13*a-c*, 15*a-c* of the present embodiment) are still engaged. This allows a portion of the core section 27 to be folded away This may be particularly beneficial when the embodiment is for use with amputees, in particular for use by the military in the field, wherein easy access to the wound is provided.

It should be appreciated that the invention has been described above purely by way of example. However, modifications in detail may be made to the invention as limited purely by the claims appended hereto.

The invention claimed is:

1. A rescue device comprising:

at least two collapsible columns defining a core section structured to support a subject to lie on the core section during use, with each collapsible column lying adjacent at least one other column; and a plurality of links, wherein each respective collapsible column of the at least two collapsible columns comprises:

a plurality of rods;

at least one connector; and a plurality of sleeves;

wherein:

each rod is located within at least one of the respective sleeves;

the plurality of rods are connectable in series by the at least one connector to form the respective collapsible column of the at least two collapsible columns; and each sleeve is connected to at least one other sleeve by attachment to at least one of the links, the links being arranged substantially perpendicularly to the at least two collapsible columns and being flexible, at least some of the links comprising an extension strap that extends out from a side of the core section and being attached to quick release buckles to enable the subject to be carried to be secured into the rescue device during use;

the rescue device further comprises handles to lift the rescue device, the handles formed either by ends of the links or by extension straps being secured between two of the links to form a loop configured to be grasped;

wherein the device further comprises at least one biaser attached to at least one end of the respective collapsible column and passing through a lumen of the respective collapsible column, and wherein an end of the at least one biaser is restrained adjacent to or around a stopper, such that the stopper is prevented from being drawn into the lumen of the respective collapsible column and is structured to prevent an entirety of the at least one biaser from being drawn into the lumen of the respective collapsible column.

2. A rescue device according to claim 1, wherein the at least two collapsible columns are substantially parallel to each other.

3. A rescue device according to claim 1, wherein the rescue device comprises at least four collapsible columns.

4. A rescue device according to claim 1, wherein each plurality of rods comprises two to ten rods connected in series.

5. A rescue device according to claim 4, wherein each of the plurality of rods comprises at least four rods connected in series.

6. A rescue device according to claim 1, wherein the at least one connector comprises a spigot and socket arrangement between the rods of each column.

7. A rescue device according to claim 1, wherein each collapsible column comprises a top end and a bottom end, and the end of the least one biaser is a corresponding top end of the biaser, the biaser further comprising a corresponding bottom end, and the top end and the bottom end of the at least one biaser are attached to the top end and bottom end, respectively, of each collapsible column of the at least two collapsible columns.

8. A rescue device according to claim 1, wherein the stopper comprises a jamb cleat attached to the top and/or bottom end of the respective collapsible column and structured to restrain the corresponding top and/or bottom end of the at least one biaser.

9. A rescue device according to claim 1, wherein the at least one biaser is an elastic elongated biaser.

10. A rescue device according to claim 1, wherein at least one of the links extends out from both sides of the core section.

11. A rescue device according to claim 1, wherein each of the plurality of sleeves is flexible.

12. A rescue device according to claim 1, wherein each of the plurality of sleeves is attached to the at least one of the links by stitching, bonding or welding.

13. A rescue device according to claim 10, wherein at least one rigid member is connected to the at least one of the links extending out from both sides of the core section.

14. A rescue device according to claim 13, wherein:

the at least one rigid member is located substantially parallel to the at least two collapsible columns, and the extension strap is made of non-rigid material.

15. A method of storing a rescue device, the rescue device comprising:

at least two collapsible columns defining a core section structured to support a subject to lie on the core section during use, with each collapsible column lying adjacent at least one other column; and a plurality of links; wherein each respective collapsible column of the at least two collapsible columns comprises:

a plurality of rods;

at least one connector; and a plurality of sleeves;

wherein each rod is located within at least one of the respective sleeves; and the plurality of rods are connectable in series by the at least one connector to form the respective collapsible column; and each sleeve is connected to at least one other sleeve by attachment to at least one of the links, the links being arranged substantially perpendicularly to the at least two collapsible columns and being flexible, at least some of the links comprising an extension strap that extends out from a side of the core section and being attached to quick release buckles to enable the subject to be carried to be secured into the rescue device during use;

the rescue device further comprising handles for lifting the rescue device, the handles formed either by ends of the links or by extension straps being secured between two links to form a loop configured to be grasped, the method comprising:

disconnecting the at least one connector, allowing the at least two collapsible columns to be folded back on themselves about the at least one connector, and folding the at least two collapsible columns back on themselves about the at least one connector, wherein the device further comprises at least one biaser attached to at least one end of the respective collapsible column and passing through a lumen of the respective collapsible column, and wherein an end of the at least one biaser is restrained adjacent to or around a stopper, such that the stopper is prevented from being drawn into the lumen of the respective collapsible column and is structured to prevent an entirety of the at least one biaser from being drawn into the lumen of the respective collapsible column.

16. A method according to claim 15, further comprising the step of restraining the rescue device in a folded position using a restraining device.

17. A rescue device comprising:

at least two collapsible columns defining a core section structured to support a subject to lie on the core section during use, with each collapsible column lying adjacent at least one other column; and a plurality of links, wherein each respective collapsible column of the at least two collapsible columns comprises:

a plurality of rods;

at least one connector; and a plurality of sleeves;

wherein:

each rod is located within at least one of the respective sleeves; and the plurality of rods are connectable in series by the at least one connector to form the respective collapsible column; and each sleeve is connected to at least one other sleeve by attachment to at least one of the links, the links being arranged substantially perpendicularly to the at least two collapsible columns and being flexible, some of the links comprising an extension strap that extends away from the core section and being attached to buckles to enable the subject to be carried to be secured into the rescue device during use, and other ones of the links comprising an extension strap that extends away from the core section to form a loop to provide handles for lifting the rescue device, wherein the device further comprises at least one biaser attached to at least one end of the respective collapsible column and passing through a lumen of the respective collapsible column, and wherein an end of the at least one biaser is restrained adjacent to or around a stopper, such that the stopper is prevented from being drawn into the lumen of the respective collapsible column and is structured to prevent an entirety of the at least one biaser from being drawn into the lumen of the respective collapsible column.

* * * * *